US008657001B2

(12) United States Patent
Whiddon

(10) Patent No.: US 8,657,001 B2
(45) Date of Patent: Feb. 25, 2014

(54) DOWNHOLE RELEASE JOINT

(75) Inventor: Richard Murray Whiddon, Katy, TX (US)

(73) Assignee: Enventure Global Technology, L.L.C., Houston, TX (US)

( * ) Notice: Subject to any disclaimer, the term of this patent is extended or adjusted under 35 U.S.C. 154(b) by 341 days.

(21) Appl. No.: 13/096,857

(22) Filed: Apr. 28, 2011

(65) Prior Publication Data

US 2012/0273231 A1 Nov. 1, 2012

(51) Int. Cl.
*E21B 29/00* (2006.01)

(52) U.S. Cl.
USPC ..... 166/277; 166/384; 166/207; 175/230

(58) Field of Classification Search
CPC ... E21B 43/103; E21B 43/105; E21B 43/106; E21B 29/10; E21B 43/108
See application file for complete search history.

(56) References Cited

U.S. PATENT DOCUMENTS

| | | | | |
|---|---|---|---|---|
| 7,007,760 | B2 | 3/2006 | Lohbeck | |
| 7,104,322 | B2 | 9/2006 | Whanger et al. | |
| 2008/0142213 | A1 | 6/2008 | Costa et al. | |
| 2009/0242213 | A1* | 10/2009 | Braddick | 166/384 |
| 2010/0025047 | A1* | 2/2010 | Sokol et al. | 166/381 |
| 2011/0094753 | A1* | 4/2011 | Whiddon | 166/377 |

FOREIGN PATENT DOCUMENTS

| | | |
|---|---|---|
| EP | 1517001 | 3/2005 |

OTHER PUBLICATIONS

Search Report and Written Opinion dated Nov. 29, 2012 for corresponding International Application No. PCT/US2012/035335 (13 pgs.).

* cited by examiner

*Primary Examiner* — Jennifer H Gay
*Assistant Examiner* — Caroline Butcher
(74) *Attorney, Agent, or Firm* — Derek V. Forinash; Porter Hedges LLP

(57) ABSTRACT

An apparatus comprises a support member operable to be disposed within a tubular member that includes a threaded connection with a pin member. The tubular member is coupled to an expansion device that is operable to radially expand the tubular member and a pin catcher that is operable to engage the pin member as the expansion device and pin catcher move axially through the tubular member.

20 Claims, 4 Drawing Sheets

DOWNHOLE RELEASE JOINT

BACKGROUND

This disclosure relates generally to hydrocarbon exploration and production, and in particular to forming wellbore tubular strings and connections to facilitate hydrocarbon production or downhole fluid injection.

During hydrocarbon exploration and production, a wellbore typically traverses a number of zones within a subterranean formation. A tubular system may be established in the wellbore to create flow paths between the multiple producing zones and the surface of the wellbore. Efficient completion of the wellbore or production from the surrounding formation is highly dependent on the inner diameter of the tubular system installed in the wellbore. Greater inner diameters of the tubular string allows inserted equipment and fluids with appropriate pressure ratings to be used in well completions, while also allowing increased production of hydrocarbons thereafter.

Expandable tubing may be used to increase the inner diameter of casing, liners and other similar downhole tubular strings used as described above. To create a casing, for example, a tubular member is installed in a wellbore and subsequently expanded by displacing an expansion device through the tubular member. The expansion device may be pushed or pulled using mechanical means, such as by a support tubular coupled thereto, or driven by hydraulic pressure. As the expansion device is displaced axially within the tubular member, the expansion device imparts radial force to the inner surface of the tubular member. In response to the radial force, the tubular member plastically deforms, thereby permanently increasing both its inner and outer diameters. In other words, the tubular member expands radially. In certain operations, expandable tubulars may be used to repair, seal, or remediate existing casing that has been perforated, parted, corroded, or damaged since installation.

In some circumstances, after the radial expansion and plastic deformation process, the expansion tools and any other tools associated therewith may need to be removed to the surface of the wellbore. Some operations include a separate trip into the wellbore, wherein a retrieval tool is lowered and coupled to the expansion tools for retrieval to the surface. In other operations, the upper unexpanded tubular string and the tools coupled thereto are separated from the lower expanded and installed tubular string for removal to the surface. To separate the unexpanded tubular string from the expanded tubular string, a cutter is used. A casing cutter may be part of the initial tool string such that the casing may be cut without an additional trip. However, the cutter operation is time-consuming and creates collateral damage to the casing. Therefore, in certain operations, utilized a casing cutter may not be acceptable.

There remains a need in the art for providing a reliable, simple apparatus and process for releasing a section of expanded tubing from unexpanded tubing. The principles of the present disclosure are directed to overcoming one or more of the limitations of the existing apparatus and processes for separating expanded tubing from unexpanded tubing and associated tools.

BRIEF DESCRIPTION OF THE DRAWINGS

For a more detailed description of the embodiments of the present disclosure, reference will now be made to the accompanying drawings, wherein.

DETAILED DESCRIPTION

Figure 1:
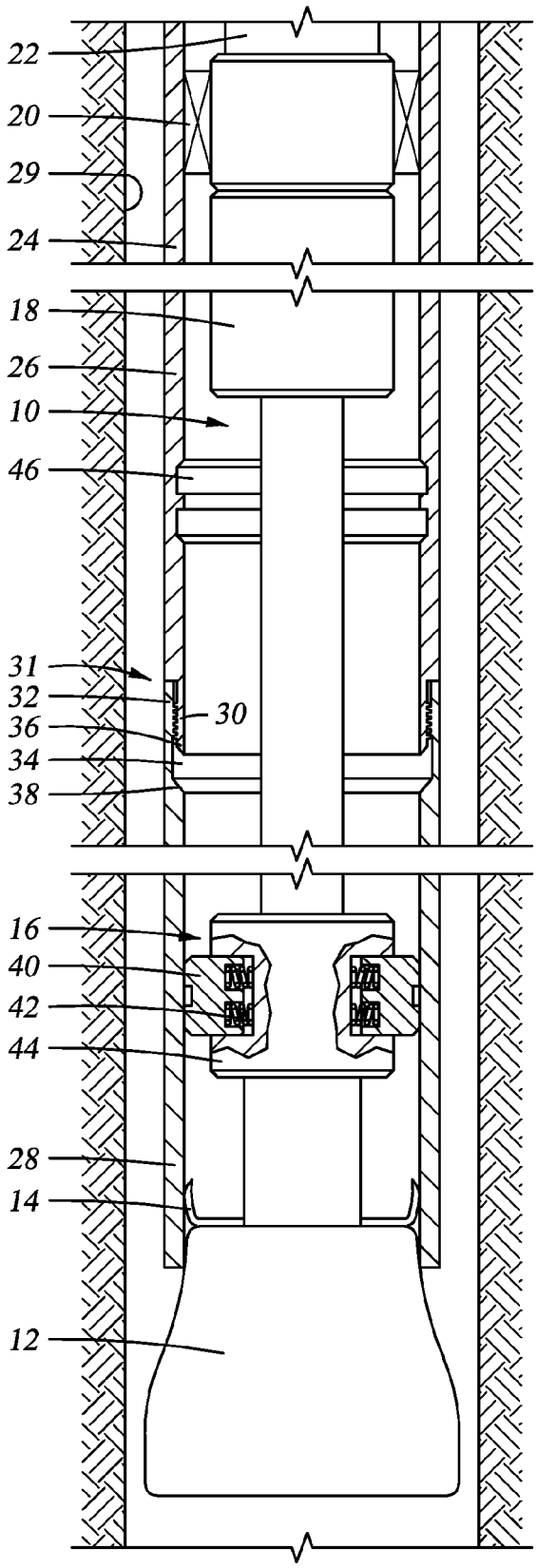
FIG. 1 is a fragmentary cross-sectional illustration of an apparatus for installing an expandable tubular member.

In the drawings and description that follow, like parts are typically marked throughout the specification and drawings with the same reference numerals. The drawing figures are not necessarily to scale. Certain features of the disclosure may be shown exaggerated in scale or in somewhat schematic form and some details of conventional elements may not be shown in the interest of clarity and conciseness. The present disclosure is susceptible to embodiments of different forms. Specific embodiments are described in detail and are shown in the drawings, with the understanding that the present disclosure is to be considered an exemplification of the principles of the invention, and is not intended to limit the invention to that illustrated and described herein. It is to be fully recognized that the different teachings of the embodiments discussed below may be employed separately or in any suitable combination to produce desired results.

In the following discussion and in the claims, the terms "including" and "comprising" are used in an open-ended fashion, and thus should be interpreted to mean "including, but not limited to . . . ". Unless otherwise specified, any use of any form of the terms "connect", "engage", "couple", "attach", or any other term describing an interaction between elements is not meant to limit the interaction to direct interaction between the elements and may also include indirect interaction between the elements described. The terms "pipe," "tubular member," "casing" and the like as used herein shall include tubing and other generally cylindrical objects. In addition, in the discussion and claims that follow, it may be sometimes stated that certain components or elements are in fluid communication. By this it is meant that the components are constructed and interrelated such that a fluid could be communicated between them, as via a passageway, tube, or conduit. The various characteristics mentioned above, as well as other features and characteristics described in more detail below, will be readily apparent to those skilled in the art upon reading the following detailed description of the embodiments, and by referring to the accompanying drawings.

Referring initially to FIG. 1, expansion assembly 10 comprises expansion device 12, pin catcher 14, latch assembly 16, actuator 18, and anchor 20 coupled to support member 22. Expansion assembly 10 is disposed within tubular member 24. Tubular member 24 and expansion assembly 10 are disposed in wellbore 29. Tubular member 24 is an expandable tubular made up of upper tubular member 26 and lower tubular member 28. Upper tubular member 26 and lower tubular member 28 may each be constructed of a plurality of tubular members joined together by threaded connections or other means, such as welding or brazing.

Lower tubular member 28 is the portion of tubular member 24 that will be expanded and left in wellbore 29. Upper tubular member 26 is the portion of tubular member 24 that will not be expanded and will be retrieved along with expansion assembly 10. The junction between upper tubular member 26 and lower tubular member 28 is defined by releasable connection 31. Releasable connection 31 is formed by threadably engaging pin member 30 of upper tubular member 26 and box member 32 of lower tubular member 28.

In order to properly function, releasable connection 31 must disconnect as lower tubular member 28 is expanded but before upper tubular member 26 is expanded. Radial expansion of upper tubular member 26 is preferably minimized so as to ensure removal of the upper tubular member from wellbore 29. The disconnection of releasable connection 31 without expansion of upper tubular member 26 may be complicated by the interaction of pin member 30 and box member 32. As lower tubular member 28 and box member 32 are radially expanded, the threaded engagement of pin member 30 and the box member may not immediately separate. This resistance to separation may result in pin member 30 being radially expanded by the expansion of box member 32. In order to reduce or eliminate this interaction, pin catcher 14 is provided to facilitate the separation of pin member 30 from box member 32 by reducing or eliminating the ability of the pin member to radially expand.

When releasable connection 31 is formed, gap 34 remains between end 36 of pin member 30 and base 38 of box member 32. Gap 34 is sized to allow engagement of pin catcher 14 but prevent engagement of latch assembly 16. As will be discussed in detail to follow, pin catcher 14 enters gap 34 and engages pin member 30. This engagement reduces the radial expansion of pin member 30 by either holding pin end 36 in place or deflecting the pin end inward, thus aiding the separation of pin member 30 from box member 32. In certain embodiments, pin member 30 may have longitudinal slots or other features that reduce the force required to deflect the pin member inward.

Once releasable connection 31 is separated, upper tubular member 26 and expansion assembly 10 can be removed from the wellbore leaving an expanded lower tubular member 28 in place. To further enhance the expansion process, upper tubular member 26 also includes receptacle 46 that is configured to engage latch assembly 16 after releasable connection 31 has been disconnected. The engagement of latch assembly 16 and receptacle 46 restricts the movement of expansion assembly 10 through upper tubular member 28 and provides a positive stop to the expansion of the upper tubular member.

Latch assembly 16 comprises a plurality of dogs 40, wherein each dog has one or more biasing members 42 that urge the dog outward. Dogs 40 are contained within housing 44 that prevents axial movement of the dogs relative to support member 22. Receptacle 46 has a profile that accepts dogs 40. Once dogs 40 engage receptacle 46, axial movement of expansion device 12 relative to upper tubular member 28 is restricted. The engagement of latch assembly 16 and receptacle 46 also provides an indication to personnel operating expansion assembly 10 that the expansion of lower tubular member 28 is complete.

Expansion device 12 may be an expansion cone or other device that radially expands the tubular member as the expansion device is moved axially therethrough. In the embodiment shown in FIGS. 1-3, expansion device 12 is moved axially through tubular member 24 by engaging the tubular member with anchor 20 and applying an axial force to the expansion device with actuator 18. Anchor 20 is activated to engage tubular member 24 and fix one end of support member 22 to the tubular member. Actuator 18 is then activated to move expansion device 12 relative to anchor 20 and through tubular member 24.

The movement of expansion device 12 is limited by the "stroke length" of actuator 18. Once actuator 18 has moved expansion device 12 the full "stroke length," anchor 20 can be released. Anchor 20 is then moved upward through tubular member 24 in conjunction actuator 18 being reset. The sequence can then be re-started to continue the expansion process until the predetermined length of tubular has been expanded. Those skilled in the art will understand that other methods, including hydraulic pressure applied directly to expansion device 12 and tension applied to support member 22 from the surface, can be used to move the expansion device through tubular member 24.

Figure 2:
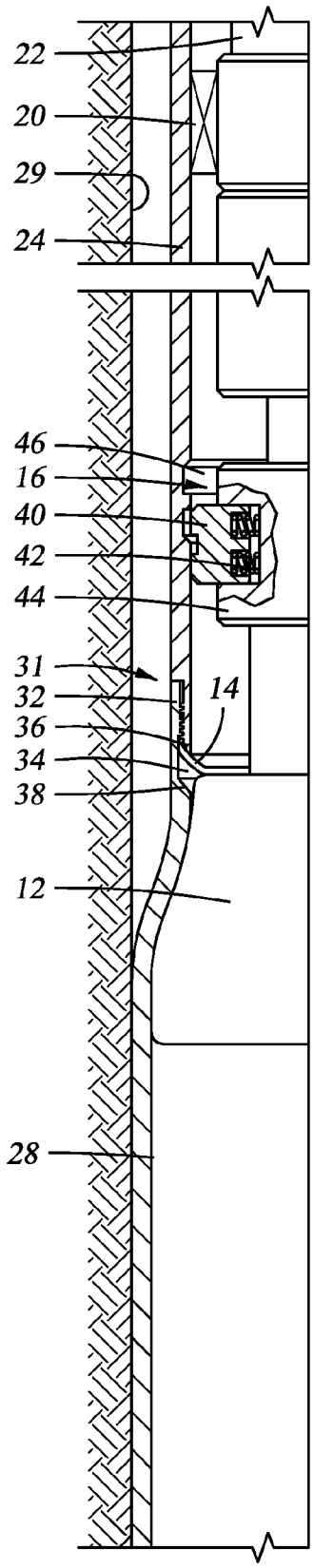
FIG. 2 is a fragmentary cross-sectional illustration of the apparatus of FIG. 1 after partially expanding the expandable tubular member.

Referring now to FIG. 2, the expansion of lower tubular member 28 is substantially complete but releasable connection 31 still couples the lower tubular member to upper tubular member 26. In the position shown, anchor 20 is engaged with upper tubular member 26 and expansion device 12 is disposed within lower tubular member 28. As actuator 18 moves expansion device 12 through lower tubular member, box member 32 begins to expand. Pin catcher 14 is positioned above expansion device 12 so that the pin catcher enters gap 34 and engages pin end 36 as box member 32 begins to expand. Dogs 40 of latch assembly 16 have not yet engaged receptacle 46 so expansion device 12 continues to move through and expand lower tubular member 28 and box member 32.

Figure 3:
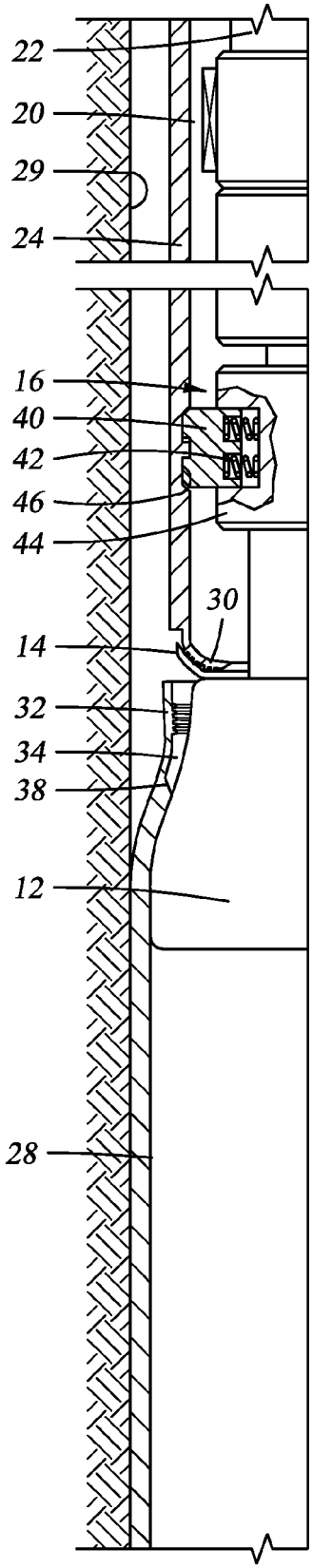
FIG. 3 is a fragmentary cross-sectional illustration of the apparatus of FIG. 1 after further expanding the expandable tubular member.

Referring now to FIG. 3, as upward movement of expansion device 12 continues, lower tubular member 28 and box member 32 are further expanded. Pin member 30 of upper tubular member 26 is retained in pin catcher 14 and is deflected inward. This inward deflection ensures that pin member 30 separates from box member 32 and releasable connection 31 is disconnected. Once releasable connection 31 is disconnected, dogs 40 of latch assembly 16 engage receptacle 46 and couple expansion assembly 10 to upper tubular member 26.

The disconnection of releasable connection 31 and coupling of expansion assembly 10 and upper tubular member 26 completes the release of the upper tubular member from lower tubular member 28. The coupled upper tubular member 26 and expansion assembly 10 can then be pulled upward as necessary to fully expand the end of lower tubular member 28. Once expansion device 12 is free from lower tubular member 28, upper tubular member 26 and expansion assembly 10 can then be retrieved to the surface, leaving expanded lower tubular member 28 in place in wellbore 29.

Figure 4:
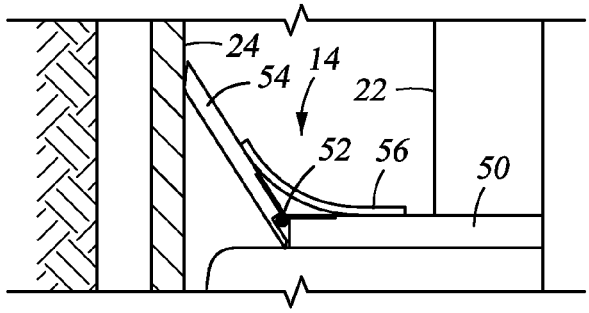
FIG. 4 is a partial schematic side view of one embodiment of a pin catcher.
Figure 5:
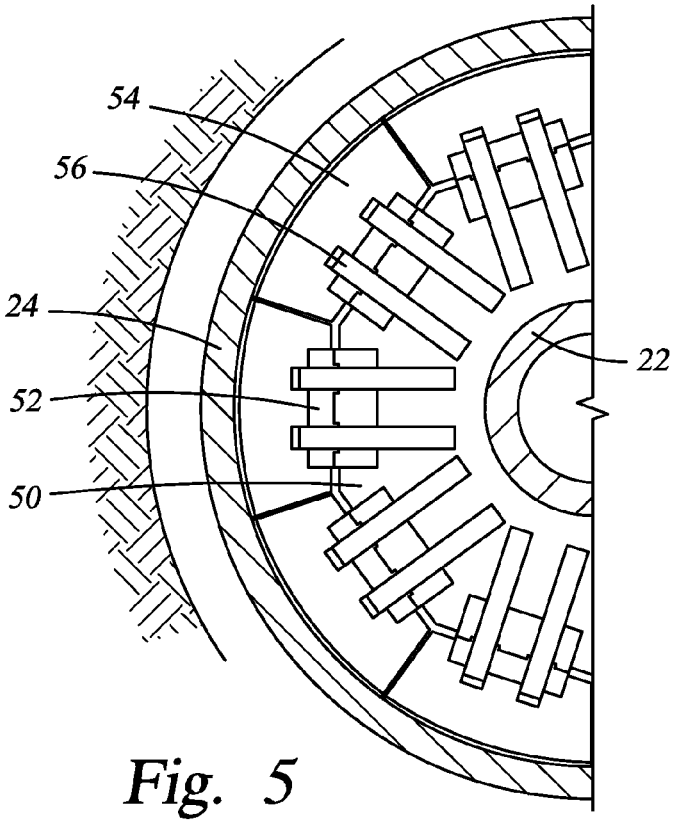
FIG. 5 is a partial schematic top view of the pin catcher of FIG. 4.

Referring now to FIGS. 4 and 5, a partial sectional view of one embodiment of pin catcher 14 is shown. Pin catcher 14 comprises base plate 50, hinge 52, engagement arm 54, and spring 56. Base plate 50 is coupled to support member 22. As seen in FIG. 5, base plate 50 supports a plurality of engagement arms 54 spaced circumferentially around base plate 50. Engagement arms 54 are arranged so as to provide substantially full circumferential engagement with pin end 36. Therefore, the number and configuration of engagement arms 54 depends on the size of the tubular for which the system is designed.

Each engagement arm 54 is rotatably coupled to base plate 50 by a hinge 52. Hinge 52 may be a mechanical hinge. In certain embodiments, engagement arms 54 may be integral to base plate 50 and hinge 52 defines the axis about which the engagement arms can rotate. Each engagement arm 54 may have one or more springs 56 are coupled thereto. Springs 56 are also coupled to base plate 50 so as to create a torque about hinge 52 that biases the engagement arm into contact with tubular 24.

Figure 6:
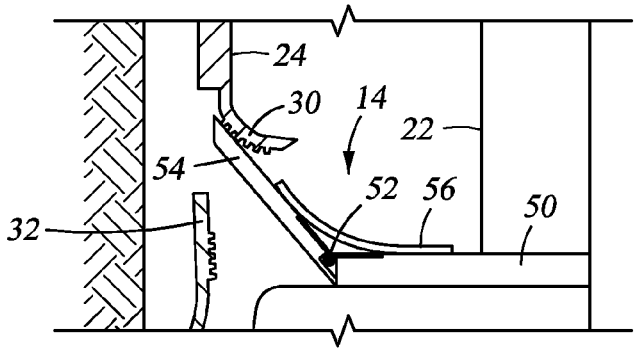
FIG. 6 is a partial schematic view of the pin catcher of FIG. 4 engaged with a pin member.

Referring now to FIG. 6, as the leading edge of engagement arm 54 enters gap 34, spring 56 rotates the engagement arm outward to an extended position. In the extended position, engagement arm 54 contacts and engages pin end 36 of pin member 30. As pin catcher 14 continues to move through tubular 24, engagement arm 54 facilitates the separation of pin member 30 from box member 32 by either deflecting pin member 30 inward (as shown) or holding the pin member in place while box member 32 is expanded outward.

Figure 7:
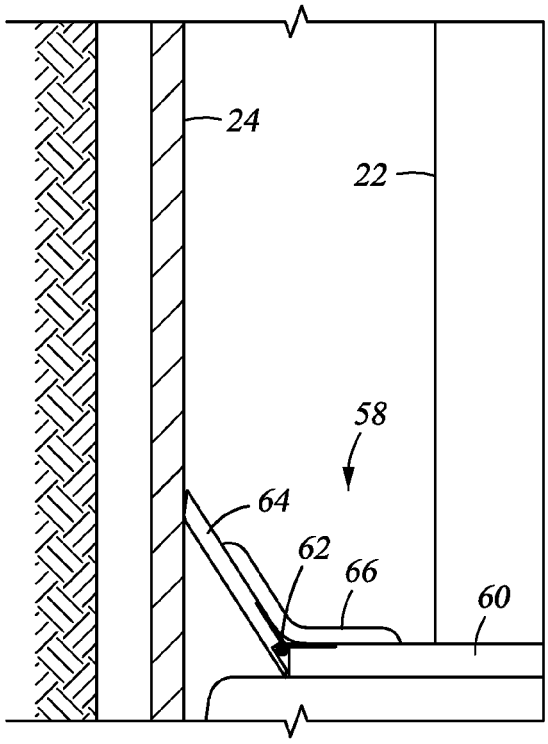
FIG. 7 is a partial schematic side view of an alternate embodiment of a pin catcher.
Figure 8:
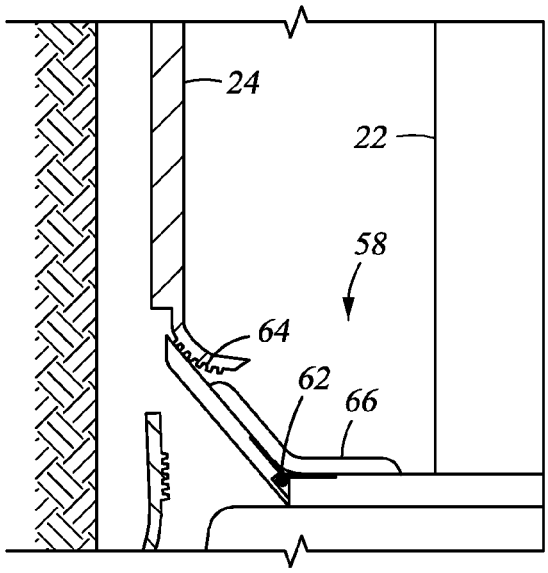
FIG. 8 is a partial schematic view of the pin catcher of FIG. 7 engaged with a pin member.

Referring now to FIGS. 7 and 8, pin catcher 58 comprises base plate 60, hinges 62, engagement arms 64, and resilient material 66. Pin catcher 58 is constructed so that resilient material 66 urges engagement arms 64 outward into an extended position contact with tubular 24. In certain embodiments, this may be accomplished by molding resilient material 66 onto pin catcher 58 with engagement arms 64 in the extended position. Engagement arms 64 would have to be rotated inward to fit into tubular member 24, which would compress resilient material 66 creating an outward force on the engagement arms.

Figure 9:
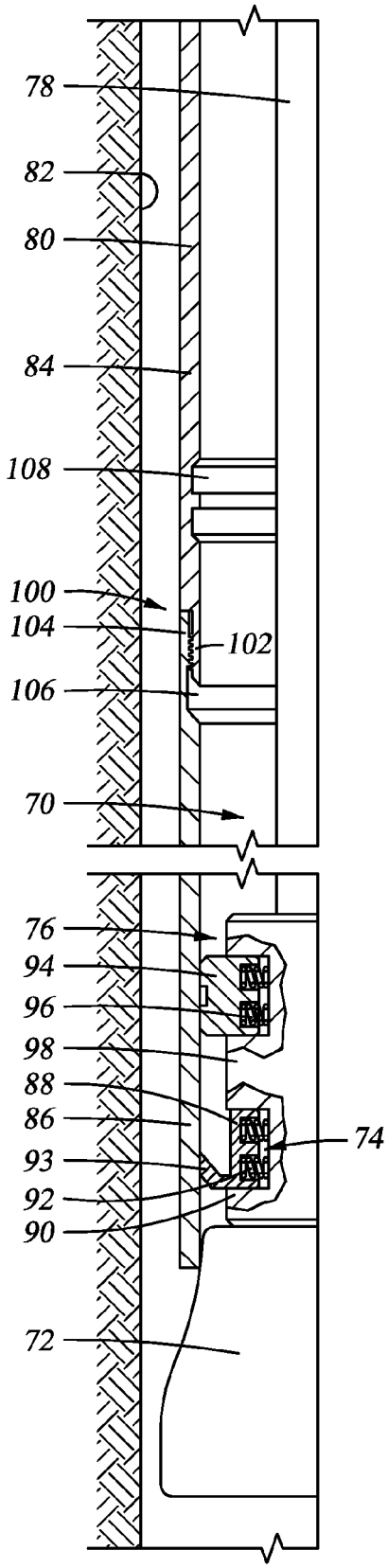
FIG. 9 is a fragmentary cross-sectional illustration of an alternate apparatus for installing an expandable tubular member.

Referring now to FIG. 9, expansion assembly 70 comprises expansion device 72, pin catcher assembly 74, and latch assembly 76 coupled to support member 78. Expansion assembly 70 is disposed within tubular member 80. Tubular member 80 and expansion assembly 70 are disposed in wellbore 82. Tubular member 80 is an expandable tubular made up of upper tubular member 84 and lower tubular member 86. Expansion assembly 70 is operable to move axially through tubular member 80 by way of tension applied from the surface, hydraulic pressure, an actuator system as described in reference to FIGS. 1-3, other means as are known in the art, or combinations thereof. The axial movement of expansion device 72 through tubular member 80 results in the radial expansion of the tubular member.

Pin catcher assembly 74 further comprises a plurality of dogs 88 disposed in housing 90 coupled to support member 78. A plurality of biasing members 92 bias pin dogs 88 outward from the centerline of support member 78. Housing 90 limits the axial and radial movement of latch dogs 88 relative to support member 78. Each pin dog 88 has an engagement member 93. Latch assembly 76 comprises a plurality of latch dogs 94, wherein each latch dog has one or more biasing members 96 that urge the latch dog outward. Latch dogs 94 are contained within housing 98 that prevents axial movement of the latch dogs relative to support member 78.

Upper tubular member 84 and lower tubular member 86 may each be constructed of a plurality of tubular members joined together by threaded connections or other means, such as welding or brazing. The junction between upper tubular member 84 and lower tubular member 86 is defined by releasable connection 100. Releasable connection 100 is formed by threadably engaging pin member 102 of upper tubular member 84 and box member 104 of lower tubular member 86.

When releasable connection 100 is formed, gap 106 remains between pin member 102 and box member 104. Gap 106 is sized to allow engagement of pin catcher 74 but prevent engagement of latch assembly 76. As will be discussed in detail to follow, pin dogs 88 enter gap 106 and engage pin member 102. In certain embodiments, pin member 102 may have longitudinal slots or other features that reduce the force required to deflect the pin member inward. Upper tubular member 84 also includes receptacle 108 that is configured to accept dogs 94 of latch assembly 76.

Figure 10:
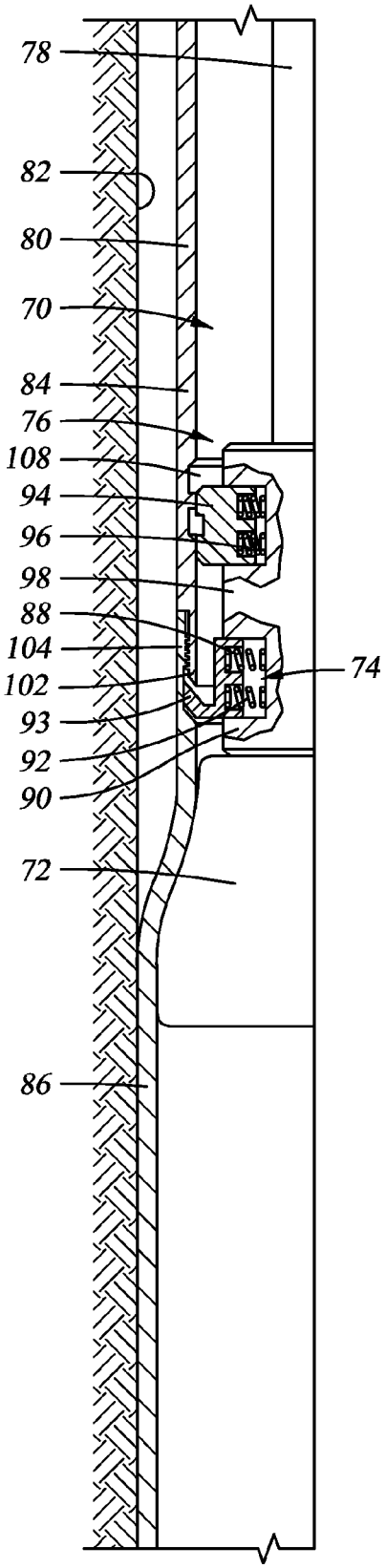
FIG. 10 is a fragmentary cross-sectional illustration of the apparatus of FIG. 1 after partially expanding the expandable tubular member.

Referring now to FIG. 10, the expansion of lower tubular member 86 is substantially complete but releasable connection 100 still couples the lower tubular member to upper tubular member 84. Pin dogs 88 have entered gap 106 and engaged pin member 102 as box member 104 has been expanded. Latch dogs 94 have not yet engaged receptacle 108 so expansion device 72 continues to move through and expand lower tubular member 86 and box member 104.

Figure 11:
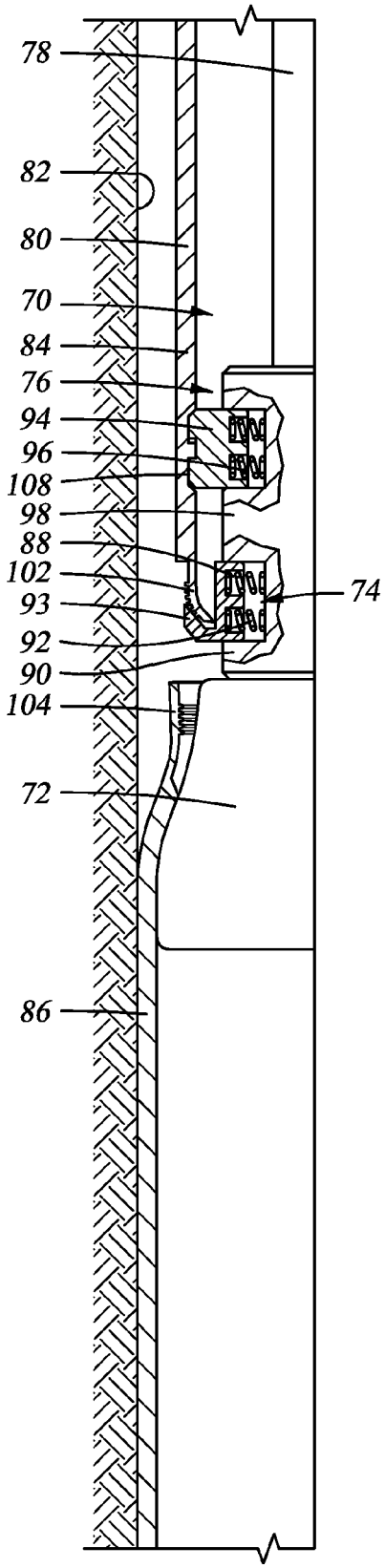
FIG. 11 is a fragmentary cross-sectional illustration of the apparatus of FIG. 1 after further expanding the expandable tubular member.

Referring now to FIG. 11, as upward movement of expansion device 72 continues, lower tubular member 86 and box member 104 are further expanded. Pin member 102 of upper tubular member 84 is retained by pin dogs 88 and is deflected inward. This inward deflection ensures that pin member 102 separates from box member 104 and releasable connection 100 is disconnected. Once releasable connection 100 is disconnected, latch dogs 94 engage receptacle 106 and couple expansion assembly 70 to upper tubular member 84.

The disconnection of releasable connection 100 and coupling of expansion assembly 70 and upper tubular member 84 completes the release of the upper tubular member from lower tubular member 86. The coupled upper tubular member 84 and expansion assembly 70 can then be pulled upward as necessary to fully expand the end of lower tubular member 86. Once expansion device 72 is free from lower tubular member 86, upper tubular member 84 and expansion assembly 70 can then be retrieved to the surface, leaving expanded lower tubular member 86 in place in wellbore 82.

In various embodiments described herein, an apparatus comprises a support member operable to be disposed within a tubular member that includes a threaded connection with a pin member. The tubular member is coupled to an expansion device that is operable to radially expand the tubular member and a pin catcher that is operable to engage the pin member as the expansion device and pin catcher move axially through the tubular member.

While the disclosure is susceptible to various modifications and alternative forms, specific embodiments thereof are shown by way of example in the drawings and description. It should be understood, however, that the drawings and detailed description thereto are not intended to limit the disclosure to the particular form disclosed, but on the contrary, the intention is to cover all modifications, equivalents and alternatives falling within the spirit and scope of the present disclosure.

The invention claimed is:

1. An apparatus comprising:

a support member operable to be disposed within a lower tubular member, wherein the lower tubular member includes a box member in threaded engagement with a pin member of an upper tubular member;

an expansion device coupled to said support member and operable to radially expand the lower tubular member as said expansion device moves axially through the lower tubular member; and a pin catcher coupled to said support member and operable to engage the pin member as said pin catcher moves axially through the lower tubular member so as to disengage the pin member from the box member as the lower tubular member is radially expanded.

2. The apparatus of claim 1, wherein said pin catcher further comprises:

an engagement member moveable to an extended position where said engagement member engages the pin member; and a biasing member operable to urge said engagement member to the extended position.

3. The apparatus of claim 2, wherein said biasing member comprises a spring.

4. The apparatus of claim 2, wherein said biasing member comprises a resilient material.

5. The apparatus of claim 1, further comprising:

a latch assembly coupled to said support member and operable to engage a corresponding latch receptacle disposed within the upper tubular member, wherein the engagement of the latch assembly and the latch receptacle limits the axial movement of said expansion device relative to the upper tubular member.

6. The apparatus of claim 5 wherein said latch assembly further comprises:

a latch housing coupled to said support member;

a plurality of dogs disposed within said latch housing; and one or more biasing members operable to bias said plurality of dogs outward into contact with the latch receptacle.

7. The apparatus of claim 1, wherein said pin catcher further comprises:

a housing coupled to said support member;

a plurality of dogs disposed within said housing; and a plurality of biasing members operable to bias said plurality of dogs into engagement with the pin member.

8. A system comprising:

an upper expandable tubular member having a pin member;

a lower expandable tubular member having a box member coupled to the pin member;

a support member operable to be disposed within said upper and lower expandable tubular members;

an expansion device coupled to said support member and operable to radially expand the lower expandable tubular member as said expansion device moves axially through the lower expandable tubular member; and a pin catcher coupled to said support member and operable to engage the pin member as said pin catcher moves axially through the lower expandable tubular member so as to disengage the pin member from the box member as the lower tubular member is radially expanded.

9. The system of claim 8, wherein said pin catcher further comprises:

an engagement member moveable to an extended position where said engagement member engages the pin member; and a biasing member operable to urge said engagement member to the extended position.

10. The system of claim 9, wherein said biasing member comprises a spring.

11. The system of claim 9, wherein said biasing member comprises a resilient material.

12. The system of claim 8, further comprising:

a latch assembly coupled to said support member and operable to engage a corresponding latch receptacle disposed within the upper expandable tubular member, wherein the engagement of the latch assembly and the latch receptacle limits the axial movement of said expansion device relative to the upper expandable tubular member.

13. The system of claim 8, wherein said pin catcher further comprises:

a housing coupled to said support member;

a plurality of dogs disposed within said housing; and a plurality of biasing members operable to bias said plurality of dogs into engagement with the pin member.

14. A method comprising:

coupling an expansion device and a pin catcher to a support member to form an expansion assembly;

disposing the expansion assembly within a lower tubular member, wherein the lower tubular member includes a box member in threaded engagement with a pin member of an upper tubular member;

moving the expansion assembly axially through the lower tubular member, wherein the expansion device radially expands the lower tubular member and the pin catcher engages the pin member as the expansion assembly moves axially through the lower tubular member so as to disengage the pin member from the box member as the lower tubular member is radially expanded.

15. The method of claim 14, wherein said pin catcher further comprises:

an engagement member moveable to an extended position where said engagement member engages the pin member; and a biasing member operable to urge said engagement member to the extended position.

16. The method of claim 15, wherein said biasing member comprises a spring.

17. The method of claim 15, wherein said biasing member comprises a resilient material.

18. The method of claim 14, further comprising:

engaging a latch receptacle disposed within the tubular member with a latch assembly that is coupled to the expansion assembly, wherein the engagement of the latch assembly and the latch receptacle limits the axial movement of said expansion device relative to the upper tubular member.

19. The method of claim 18, wherein said latch assembly further comprises:

a latch housing coupled to said support member;

a plurality of dogs disposed within said latch housing; and one or more biasing members operable to bias said plurality of dogs outward into contact with the latch receptacle.

20. The method of claim 14, wherein the pin catcher further comprises:

a housing coupled to said support member;

a plurality of dogs disposed within said housing; and a plurality of biasing members operable to bias said plurality of dogs into engagement with the pin member.

* * * * *